US008399052B2

(12) United States Patent
Stecker

(10) Patent No.: US 8,399,052 B2
(45) Date of Patent: Mar. 19, 2013

(54) METHODS OF APPLYING METAL COATINGS TO OBJECTS

(75) Inventor: William M. Stecker, Hillsborough, NC (US)

(73) Assignee: Alchemy Dimensional Graphics, LLC, Hillsborough, NC (US)

( * ) Notice: Subject to any disclaimer, the term of this patent is extended or adjusted under 35 U.S.C. 154(b) by 201 days.

(21) Appl. No.: 12/861,960

(22) Filed: Aug. 24, 2010

(65) Prior Publication Data

US 2012/0052198 A1 Mar. 1, 2012

(51) Int. Cl.
*B05D 1/12* (2006.01)

(52) U.S. Cl. ..... 427/202; 427/201; 427/205; 427/282

(58) Field of Classification Search ..... 427/201, 427/202, 205, 282
See application file for complete search history.

(56) References Cited

U.S. PATENT DOCUMENTS

| | | | | |
|---|---|---|---|---|
| 4,243,696 | A * | 1/1981 | Toth | 427/474 |
| 4,301,763 | A * | 11/1981 | Goldstone et al. | 118/308 |
| 4,675,216 | A * | 6/1987 | DuForest et al. | 427/559 |
| 5,045,114 | A * | 9/1991 | Bigalk et al. | 106/404 |
| 5,393,568 | A | 2/1995 | Valente et al. | |
| 6,444,260 | B2 * | 9/2002 | Kramer et al. | 427/201 |
| 6,541,540 | B2 * | 4/2003 | Hashizume | 523/205 |
| 2002/0013398 | A1 * | 1/2002 | Ido et al. | 524/441 |
| 2007/0151663 | A1 * | 7/2007 | Steinmann et al. | 156/297 |

* cited by examiner

*Primary Examiner* — Frederick Parker
(74) *Attorney, Agent, or Firm* — Myers Bigel Sibley & Sajovec, P.A.

(57) ABSTRACT

A method of coating an object includes applying a heterogeneous mixture of polymeric powder and metal powder to a surface of an object and heating the surface for a period of time sufficient to cause the polymeric powder to cure and form a coating on the surface. The cured polymeric coating may then be subjected to one or more finishing operations. The resulting coating contains a substantially equal distribution of metal powder throughout a thickness thereof. The powder mixture may adhere to adhesive material applied to one or more surfaces of an object. The powder mixture may adhere to one or more heated surfaces of an object.

22 Claims, 6 Drawing Sheets

METHODS OF APPLYING METAL COATINGS TO OBJECTS

FIELD OF THE INVENTION

The present invention relates generally to coatings and, more particularly, to metal coatings.

BACKGROUND OF THE INVENTION

The practice of applying a metal coating or veneer to various objects has long been practiced for practical and aesthetic purposes. For example, precious metals such as gold silver and platinum can be plated to the surfaces of inexpensive objects to give the objects the appearance, luster and physical properties of the precious metal. The application of gold "leaf" to diverse substrates has been used architecturally for centuries. Silver plating gives silverware the appearance and performance of solid silver without the expense. Coatings of less precious metals such as brass, nickel, bronze, chrome, tin, zinc and copper are also utilized for aesthetic and functional purposes.

A popular method of metal coating that has been around for more than a century is electroplating. Electroplating is a plating process that uses electrical current to reduce cations of a desired material from a solution and coat a conductive object with a thin layer of the material, such as a metal. Electroplating is primarily used for depositing a layer of material to bestow a desired property (e.g., abrasion and wear resistance, corrosion protection, lubricity, aesthetic qualities, etc.) to a surface that otherwise lacks that property. Another application uses electroplating to build up the thickness of undersized parts. Electroplating has excellent transfer ratios but utilizes hazardous chemicals and processes. Electroplating is also limited to substrates which are electrically conductive and which can survive in the aquatic, acid environments necessary for the process.

Obtaining a uniform coating thickness with electroplating can be difficult for objects with multiple surfaces and complex shapes. The plating metal is preferentially attracted to external corners and protrusions, but unattracted to internal corners and recesses. These difficulties can be overcome with multiple anodes or a specially shaped anode that mimics the object geometry; however both of these solutions may increase cost.

In addition to the technical difficulty and sophistication required to practice electroplating the process is environmentally problematic. The stripping, etching, preparation and application steps associated with electroplating involve many hazardous chemicals such as sulfuric acid, chromic acid, cyanide and sodium hydroxide.

Another process for coating a metal surface is mechanical plating, also known as peen plating, mechanical deposition, and impact plating. Mechanical plating is a process that imparts a coating by cold welding fine metal particles to a work piece. The process typically uses fine metal powder, a tumbler on steel media to "peen" or pound the metal powder onto the target object's surface. This is used to plate screws, rivets, and the like.

Methods for depositing metal coatings such as chromium, nickel, cadmium, and copper in traditional electroplating processes have inherent pollution problems. Several alternative technologies exist to coat a substrate with metal without using electrolytic solutions or plating baths. These technologies do not eliminate the use of metal coatings, but they do eliminate the use of non-metal toxic components such as cyanide from the plating process. They also can reduce the amount of metal-contaminated wastewater and sludge that is generated from plating. These alternative technologies include thermal spray coating, vapor deposition, and chemical vapor deposition.

These alternative processes may have high unit-plating costs and, therefore, are typically used only for special applications where the cost of coating is not a major consideration. Another drawback to alternative metal deposition methods is that metal overspray or tailings from re-machining thick coatings from the alternative processes can actually increase waste generation.

Another conventional method for applying metal coatings involves spraying an object with a liquid polymer, such as unsaturated polyester resin, mixed with a catalyst and metal powder. This process is commercially called cold spray metal application. This process, like electroplating, is environmentally hazardous and wasteful of materials. U.S. Pat. No. 5,393,568 to Valente et al. describes a cold spray process that involves mixing three components: a reactive resin, a catalyst, and metal powder. The mixture is sprayed thru a high volume low pressure (HVLP) spray gun. The metal powder with its high specific gravity relative to the resin vehicle rapidly settles out of the mixture unless the mixture is continuously agitated, which is very difficult to do, if not impossible, during spraying. The mixture is also subject to premature catalization which can destroy the equipment used to apply it. At a minimum a significant amount of material is wasted as it must be prepared and used in batches and disposed of before it sets up in the equipment.

As with all spray processes, the transfer rate of the Valente process varies with the size and shape of the object to be coated and the skill of the operator. In practice, a large amount, often more than 50%, of the material mix may miss the target. This material is not recoverable and must be disposed of. The Valente process is also problematic in that the same settling which can occur in the equipment tends to take place on the sprayed object. The metal powder sinks to the bottom of the coating against the target object while the resin floats to the top before the resin can cure. In fact, polymerization may take 8 to 20 minutes, which may lead to running and sagging in addition to stratification. This creates a metal rich stratum against the object and a resin rich stratum away from the object. In order to achieve a decorative metallic surface, the resin must (after the mixture cures in place) be removed by abrasion to expose the metal sub-stratum. Such post finishing abrasive steps (sanding and polishing) can also limit the commercial viability of this process especially on complex shapes or highly detailed pieces. Unfortunately, attempts to overcome this by increasing the metal component make spraying the mixture problematic. Also, the Valente procedure includes the risk sagging and running, as with most liquid spray coatings.

There are several methods for imparting a metallic look to a substrate, all of which involve the use of reflective metallic particles or flakes. The application of metallic paints fall in this category. However, unlike true metalizing processes the use of metal flake in paint imparts only superficial surface properties. These materials typically cannot be post finished or polished as can true metals or true metal coatings. These materials achieve their metallic look by orientation of reflective flakes giving a synthetic metallic luster.

Powder coatings that are cured with heat can also achieve metallic looks with the use of metal flake, but, as with sprayable coatings, are difficult, if not impossible, to post finish as their surface is not truly metallic. Powder coatings are applied with a low pressure gun and use electrostatic charge for the initial adhesion to the target surface. Alternatively powder coatings may be applied by using fluidized bed technology which creates a cloud of powder coat particles into which the charged material is introduced.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

A method of coating an object, according to some embodiments of the present invention, includes applying a heterogeneous mixture of polymeric powder and metal powder to a surface of an object and heating the surface for a period of time sufficient to cause the polymeric powder to cure and form a coating on the surface. Neither the object nor the particles of the powder mixture have an electrical charge that causes the powder mixture and object surface to be attracted to each other. In fact, if the surface of the object was tilted, prior to curing the polymeric powder, the powder mixture would fall off of the surface.

The cured polymeric coating may then be subjected to one or more finishing operations, such as polishing, buffing, sanding, chemical treatment, etc. The resulting coating contains a substantially equal distribution of metal powder throughout a thickness thereof. The polymeric powder and metal powder have a specific gravity difference of at least about 2, and the polymeric powder comprises between about 10% and 90% by volume of the mixture.

The polymeric powder may be a thermosetting polymeric material such as, but not limited to, polyester, epoxy, acrylic, urethane, and blends and/or hybrids thereof. The polymeric powder may be a thermoplastic polymeric material such as, but not limited to, acrylic, vinyl, nylon, and blends and/or hybrids thereof. In some embodiments, the polymeric powder may be a translucent polymeric material. In other embodiments, the polymeric powder may be a pigmented polymeric material. The metal powder may be virtually any type of material such as, but not limited to, copper, bronze, brass, nickel, iron, steel, tin, silver, stainless steel, gold, and/or blends thereof.

In some embodiments, a second heterogeneous mixture of polymeric powder and metal powder is applied to the surface of an object containing the first powder mixture prior to heating the object. The metal powder in the second powder mixture is different from the metal powder in the first powder mixture, and the polymeric powder and metal powder in the second powder mixture have a specific gravity difference of at least about 2. As with the first powder mixture, the polymeric powder in the second powder mixture comprises between about 10% and 90% by volume of the second powder mixture. Moreover, as with the first powder mixture, there is no electrical attraction between the object surface and particles in the second powder mixture.

A method of coating an object, according to other embodiments of the present invention, includes heating one or more surfaces of an object to a first temperature, exposing the one or more heated surfaces to a heterogeneous mixture of polymeric powder and metal powder, and heating the one or more surfaces to a second temperature greater than the first temperature for a period of time sufficient to cause the polymeric powder to cure and form a coating on the one or more surfaces. The first temperature is sufficient to cause the polymeric powder to adhere to the one or more surfaces of the object. The second temperature is greater than or equal to the melting temperature of the polymeric powder. The cured polymeric coating may then be subjected to one or more finishing operations, such as polishing, buffing, sanding, chemical treatment, etc. The resulting coating contains a substantially equal distribution of metal powder throughout a thickness thereof.

A method of coating an object, according to other embodiments of the present invention, includes applying a solvent-based adhesive substance to one or more surfaces of an object, exposing the one or more surfaces to a heterogeneous mixture of polymeric powder and metal powder such that the polymeric powder adheres to the adhesive substance on the one or more surfaces, heating the one or more surfaces to a first temperature such that solvent in the solvent-based adhesive substance evaporates, and heating the one or more surfaces to a second temperature greater than the first temperature for a period of time sufficient to cause the polymeric powder to cure and form a coating on the one or more surfaces. The second temperature is greater than or equal to the melting temperature of the polymeric powder. The cured polymeric coating may then be subjected to one or more finishing operations, such as polishing, buffing, sanding, chemical treatment, etc. The resulting coating contains a substantially equal distribution of metal powder throughout a thickness thereof, as described above.

The adhesive substance may be applied to a surface of an object in various ways. In some embodiments, the object is dipped in the adhesive substance. In other embodiments, the adhesive substance is sprayed on, brushed on, or otherwise applied to the one or more surfaces. In some embodiments, an adhesive substance may be applied to a surface in a pattern.

Applying a heterogeneous mixture of polymeric powder and metal powder to a surface of an object, according to the various embodiments of the present invention, may be performed in various ways. In some embodiments, a container of the powder mixture is capped with a mesh screen, and the powder mixture is applied, for example, like salt from a salt shaker. The target object may be stationary or may be rotated to position all surfaces thereof to the descending particles. In some embodiments, the object is conveyed through a curtain of the mixture of polymeric powder and metal powder. The object may be stationary or may be rotated to position all surfaces thereof to the powder mixture as it is conveyed through the powder mixture curtain. In other embodiments, the object may be positioned beneath a screen and the powder mixture is passed through the screen. The screen may have a pattern in some embodiments such that passing the powder mixture through the screen forms a corresponding pattern on the surface of the object. In other embodiments, the object is agitated within an enclosure containing the powder mixture.

In all of the embodiments of the present invention, there is no electrical charge attraction between the particles in the powder mixture and the surface of an object. Moreover, in all of the embodiments of the present invention, the powder mixture is a dry mixture and no liquids are utilized to transport the powder mixture to an object surface.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
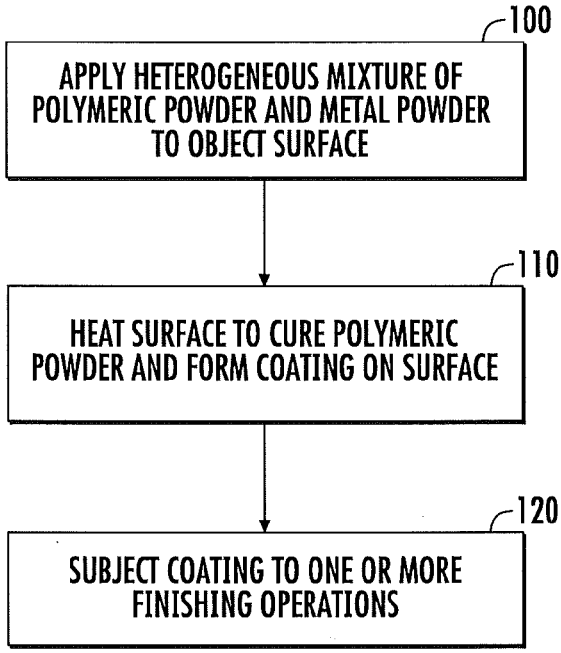
FIG. 1 is a flow chart of operations for coating an object, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terms "polymer", "polymeric", and "plastic", as used herein, have the same meaning and are interchangeable.

It will be understood that although the terms first and second are used herein to describe various features/elements, these features/elements should not be limited by these terms. These terms are only used to distinguish one feature/element from another feature/element. Thus, a first feature/element discussed below could be termed a second feature/element, and similarly, a second feature/element discussed below could be termed a first feature/element without departing from the teachings of the present invention. Like numbers refer to like elements throughout.

Embodiments of the present invention include methods of applying a metal coating to various types of objects. The surface of virtually any type of object may be coated including, but not limited to, planar objects, multi-surfaced objects, three dimensional objects, flexible objects, objects with curved surfaces, etc.

Referring initially to FIG. 1, a method of coating an object, according to some embodiments of the present invention, includes applying a heterogeneous mixture of polymeric powder and metal powder to a surface of an object (Block 100) and heating the surface for a period of time sufficient to cause the polymeric powder to cure and form a coating on the surface (Block 110). The cured polymeric coating may then be subjected to one or more finishing operations (Block 120), such as polishing, buffing, sanding, chemical treatment, etc. The resulting coating contains a substantially equal distribution of metal powder throughout a thickness thereof. Stated otherwise, the metal powder density is substantially constant (i.e., there is a consistent plastic to metal ratio) throughout the entire thickness of the coating layer. The resulting homogeneity achieved by this method of coating allows for substantial material removal without changing the aesthetic or functional properties of the coating. For example, if any portion of the coating is removed, such as via sanding or normal wear, the same distribution of metal powder and thus resulting properties are exhibited at the newly exposed outer surface as at the initial outer surface.

The polymeric powder and metal powder have a specific gravity difference of at least 2, and the polymeric powder comprises between about 10% and 90% by volume of the mixture. The specific gravity of exemplary polymeric powder particles is in the range of between about 0.9 and about 1.4. The specific gravity of exemplary metal powder particles is in the range of between about 2.8 and about 8.

The polymeric powder may be a thermosetting polymeric material such as, but not limited to, polyester, epoxy, acrylic, urethane, and blends and/or hybrids thereof. The polymeric powder may be a thermoplastic polymeric material such as, but not limited to, acrylic, vinyl, nylon, and blends and/or hybrids thereof. In some embodiments, the polymeric powder may be a translucent polymeric material. In other embodiments, the polymeric powder may be a pigmented polymeric material. Exemplary particle sizes of the polymeric powder are within the range of about 20-60 microns; however, other sizes may be utilized.

The metal powder may be virtually any type of material such as, but not limited to, copper, bronze, brass, nickel, iron, steel, tin, silver, stainless steel, gold, and/or blends thereof. Exemplary particle sizes of the metal powder are within the range of 50-100 microns; however, other sizes may be utilized.

Applying the heterogeneous mixture of polymeric powder and metal powder to a surface of an object may be performed in various ways. In some embodiments, a container of the powder mixture is capped with a mesh screen, and the powder mixture is applied like salt from a salt shaker. The target object may be stationary or may be rotated to position all surfaces thereof to the descending particles. However, neither the object nor the particles in the powder mixture have an electrical charge that causes the powder mixture and object surface to be attracted or adhere to each other.

In some embodiments, the object is conveyed through a "curtain" of powder mixture falling under the force of gravity from a source. For example, in some embodiments, a powder mixture is delivered via a conveyor to an oscillating screen (e.g., a 155 mesh screen, etc.) that creates a continuous powder curtain through which the target object is passed. The object may be stationary (i.e., is not rotated, etc.) as it is conveyed through the powder mixture curtain or may be rotated to position all surfaces thereof to the powder mixture curtain.

Figure 2:
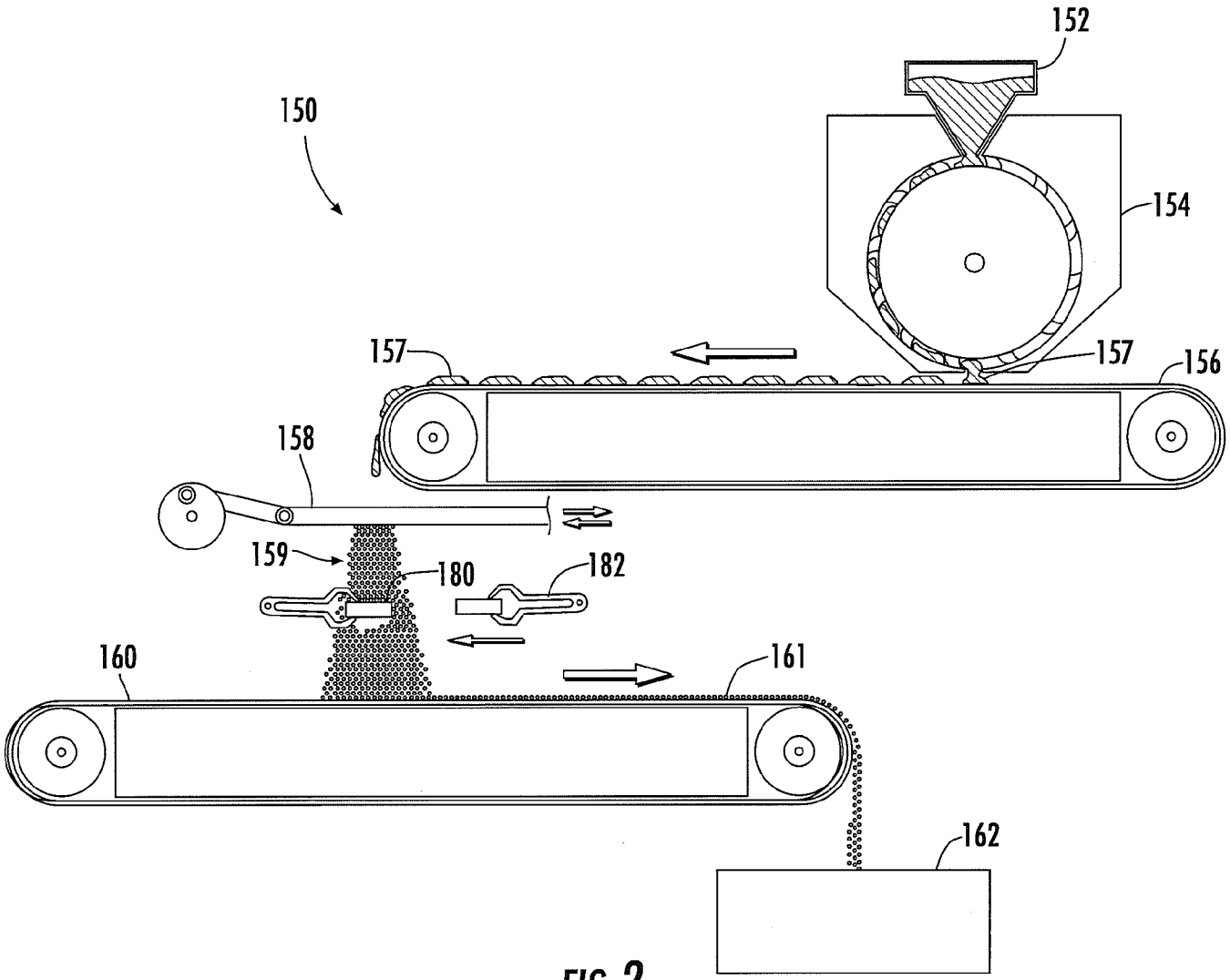
FIG. 2 illustrates a metal coating system, according to some embodiments of the present invention.

FIG. 2 illustrates a system 150 for applying a heterogeneous mixture of polymeric powder and metal powder to a target object 180, according to some embodiments of the present invention. The illustrated system 150 includes a powder source 152 that provides a mixture of polymer powder and metal powder to a dry powder pump 154. The dry powder pump 154 delivers a predetermined amount of the powder mixture 157 to a conveyor 156. The conveyor 156 delivers the powder mixture 157 to an oscillating/vibrating screen 158 through which the powder mixture falls to produce a powder curtain 159. The target object 180 is inserted and removed from the powder curtain via an insertion device 182. The insertion device 182 can be a manually activated device or a robotic device. Excess powder mixture 161 is accumulated for reuse via a conveyor 160 that collects and delivers the excess powder mixture 161 to an accumulator 162.

Figure 3A:
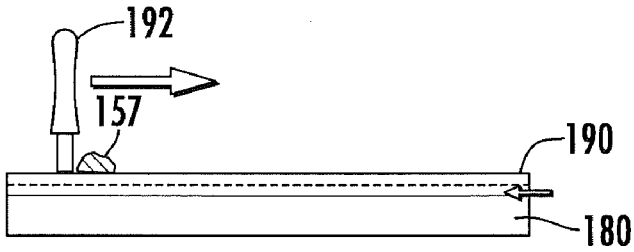
FIG. 3A is a side view of a stencil for applying a powder mixture to an object underlying the stencil, according to some embodiments of the present invention.
Figure 3B:
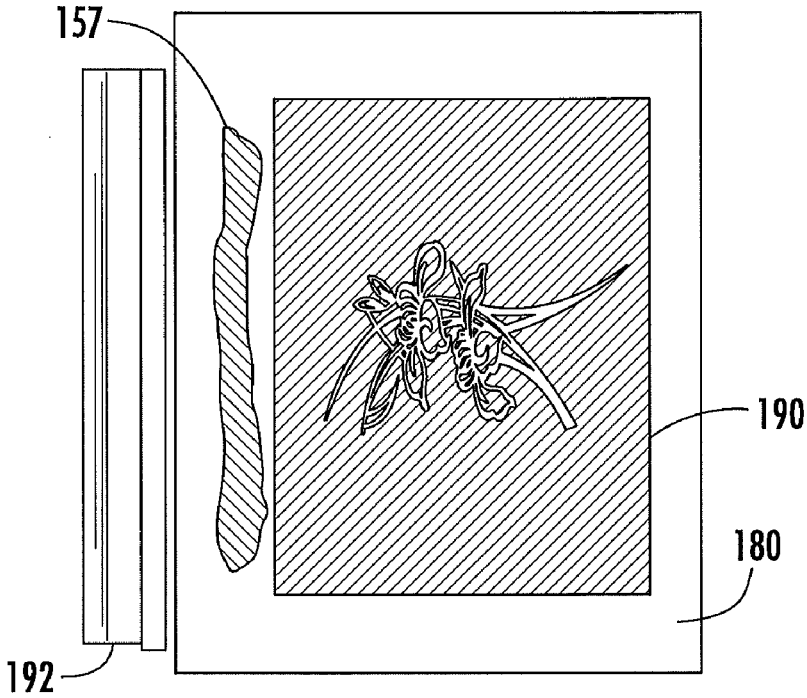
FIG. 3B is a top plan view of the stencil of FIG. 3A illustrating a pattern formed in the stencil.
Figure 3C:
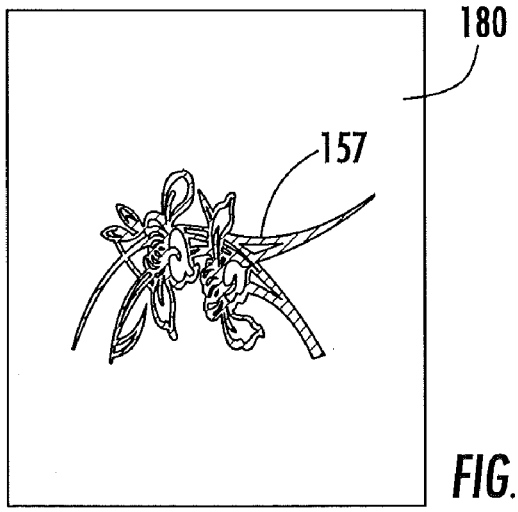
FIG. 3C is a top plan view of the object having a pattern of powder mixture on the surface thereof applied thereto via the stencil of FIGS. 3A and 3B.

In other embodiments, the object may be positioned beneath a screen and the powder mixture is passed through the screen, similar to a silk screen operation. The screen may have a pattern in some embodiments such that passing the powder mixture through the screen forms a corresponding pattern on the surface of the object. For example, as illustrated in FIGS. 3A and 3B, a target object 180 is positioned beneath a stencil 190. A heterogeneous mixture 157 of polymeric powder and metal powder is drawn across the stencil, for example via a doctor blade 192. The stencil pattern through which the powder mixture passes creates a corresponding pattern of the powder mixture 157 on the target object 180, as illustrated in FIG. 3C.

In other embodiments, an object may be agitated within an enclosure containing a powder mixture. For example, an object may be placed within a bag, or other container, containing the powder mixture and then shaken to expose the object surface(s) to the powder mixture.

In some embodiments, a second heterogeneous mixture of polymeric powder and metal powder is applied to the surface of an object prior to heating the object. The metal powder in the second mixture is different from the metal powder in the first mixture, and the polymeric powder and metal powder in the second mixture have a specific gravity difference of at least about 2. As with the first powder mixture, the polymeric powder in the second mixture comprises between about 10% and 90% by volume of the second mixture. Neither the object nor the particles in the second powder mixture have an electrical charge that causes the particles to adhere to or be attracted to the object surface.

Figure 4:
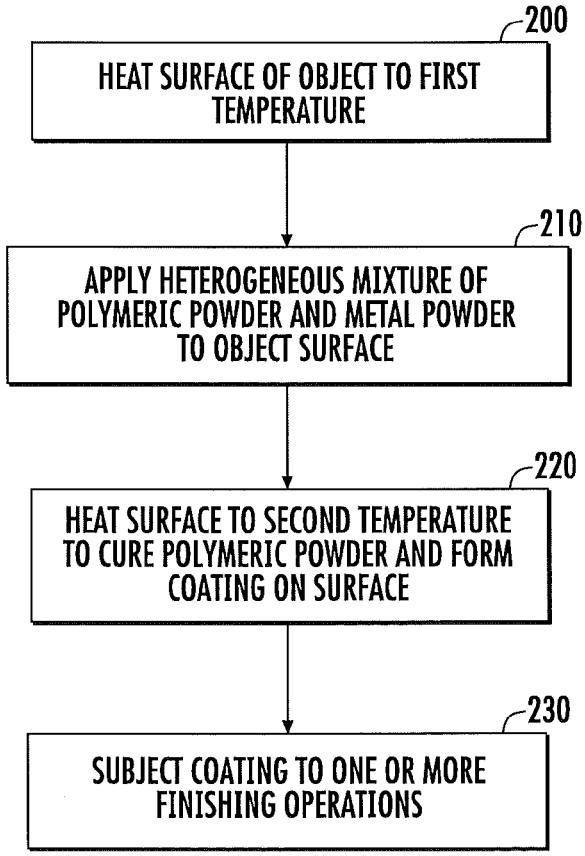
FIGS. 4 and 5 are flow charts of operations for coating an object, according to some embodiments of the present invention.

Referring to FIG. 4, a method of coating an object, according to other embodiments of the present invention, includes heating one or more surfaces of an object to a first temperature (Block 200), exposing the one or more heated surfaces to a heterogeneous mixture of polymeric powder and metal powder (Block 210), and heating the one or more surfaces to a second temperature greater than the first temperature for a period of time sufficient to cause the adhered polymeric powder in the mixture to cure and form a coating on the one or more surfaces (Block 220). The first temperature is sufficient to cause the polymeric powder to adhere to the one or more surfaces of the object. For example, the first temperature is sufficient to cause the powder mixture to cling uniformly to the object. In some embodiments, the first temperature may be above the melt/flow temperature of the host polymeric powder. In some embodiments, the second temperature is greater than or equal to the melting temperature of the polymeric powder. The cured polymeric coating may then be subjected to one or more finishing operations (Block 230), such as polishing, buffing, sanding, chemical treatment, etc. The resulting coating contains a substantially equal distribution of metal powder throughout a thickness thereof, as described above.

The polymeric powder and metal powder have a specific gravity difference of at least about 2, and the polymeric powder comprises between about 10% and 90% by volume of the mixture. As described above, the specific gravity of exemplary polymeric powder particles is in the range of between about 0.8 and about 1.2, and the specific gravity of exemplary metal powder particles is in the range of between about 2.8 and about 8.

The polymeric powder may be a thermosetting polymeric material such as, but not limited to, polyester, epoxy, acrylic, urethane, and blends and/or hybrids thereof. The polymeric powder may be a thermoplastic polymeric material such as, but not limited to, acrylic, vinyl, nylon, and blends and/or hybrids thereof. In some embodiments, the polymeric powder may be a translucent polymeric material. In other embodiments, the polymeric powder may be a pigmented polymeric material. Exemplary particle sizes of the polymeric powder are within the range of about 20-60 microns; however, other sizes may be utilized.

The metal powder may be virtually any type of material such as, but not limited to, copper, bronze, brass, nickel, iron, steel, tin, silver, stainless steel, gold, and/or blends thereof. Exemplary particle sizes of the metal powder are within the range of about 50-100 microns; however, other sizes may be utilized.

Exposing the one or more heated surfaces to the heterogeneous mixture of polymeric powder and metal powder may be performed in various ways. In some embodiments, a container of the powder mixture is capped with a mesh screen, and the powder mixture is applied to a heated surface like salt from a salt shaker. The target object may be stationary or may be rotated to position all heated surfaces thereof to the descending particles. In some embodiments, the object is conveyed through a curtain of the mixture of polymeric powder and metal powder falling under the force of gravity from a source. The object may be stationary or may be rotated to position all heated surfaces thereof to the powder mixture as it is conveyed through the powder mixture curtain. In other embodiments, the object may be positioned beneath a screen and the powder mixture is passed through the screen. The screen may have a pattern in some embodiments such that passing the powder mixture through the screen forms a corresponding pattern on the heated surface of the object.

In other embodiments, the object may be agitated within an enclosure containing the powder mixture. For example, the object may be placed within a bag, or other container, containing the powder mixture and then shaken to expose the heated surface(s) of the object to the powder mixture.

In some embodiments, a second heterogeneous mixture of polymeric powder and metal powder is applied to the heated surface prior to heating the object to the second temperature. The metal powder in the second mixture is different from the metal powder in the first mixture, and the polymeric powder and metal powder in the second mixture have a specific gravity difference of at least 2. As with the first powder mixture, the polymeric powder in the second mixture comprises between about 10% and 90% by volume of the second mixture.

Figure 5:
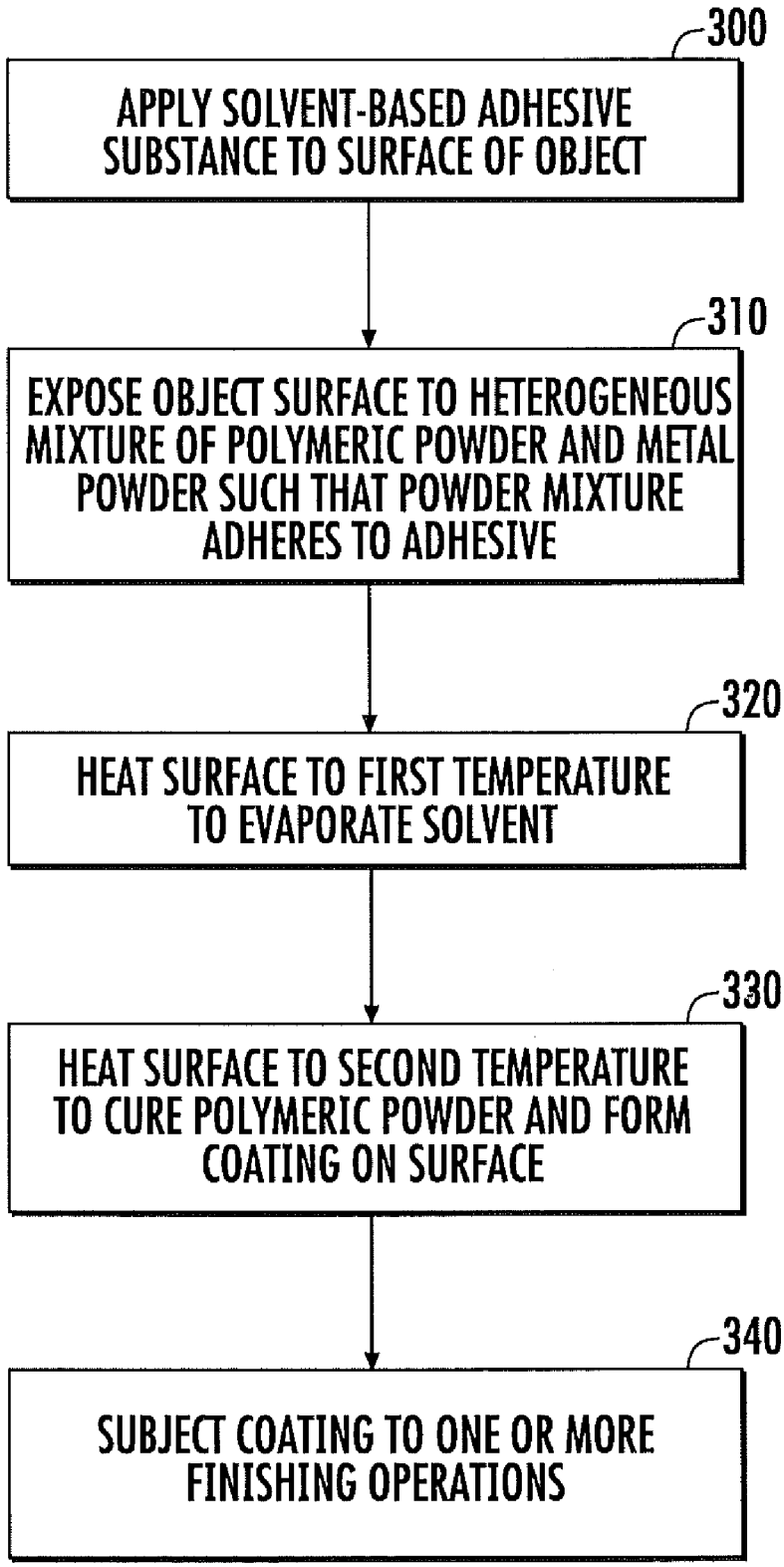

Referring to FIG. 5, a method of coating an object, according to other embodiments of the present invention, includes applying a solvent-based adhesive substance to one or more surfaces of an object (Block 300), exposing the one or more surfaces to a heterogeneous mixture of polymeric powder and metal powder such that the polymeric powder adheres to the adhesive substance on the one or more surfaces (Block 310), heating the one or more surfaces to a first temperature such that solvent in the solvent-based adhesive substance evaporates (Block 320), and heating the one or more surfaces to a second temperature greater than the first temperature for a period of time sufficient to cause the polymeric powder to cure and form a coating on the one or more surfaces (Block 330). In some embodiments, the second temperature may be greater than or equal to the melting temperature of the polymeric powder. The cured polymeric coating may then be subjected to one or more finishing operations (Block 340), such as polishing, buffing, sanding, chemical treatment, etc. The resulting coating contains a substantially equal distribution of metal powder throughout a thickness thereof, as described above.

The adhesive substance may be applied to a surface of an object in various ways. In some embodiments, the object is dipped in the adhesive substance. In other embodiments, the adhesive substance is sprayed or otherwise applied onto the one or more surfaces. In some embodiments, an adhesive substance may be applied to a surface in a pattern.

As described above, the polymeric powder and metal powder have a specific gravity difference of at least 2, and the polymeric powder comprises between about 10% and 90% by volume of the mixture. As described above, the specific gravity of exemplary polymeric powder particles is in the range of between about 0.8 and about 1.2, and the specific gravity of exemplary metal powder particles is in the range of between about 2.8 and about 8.

The polymeric powder may be a thermosetting polymeric material such as, but not limited to, polyester, epoxy, acrylic, urethane, and blends and/or hybrids thereof. The polymeric powder may be a thermoplastic polymeric material such as, but not limited to, acrylic, vinyl, nylon, and blends and/or hybrids thereof. In some embodiments, the polymeric powder may be a translucent polymeric material. In other embodiments, the polymeric powder may be a pigmented polymeric material. Exemplary particle sizes of the polymeric powder are within the range of about 20-60 microns; however, other sizes may be utilized.

The metal powder may be virtually any type of material such as, but not limited to, copper, bronze, brass, nickel, iron, steel, tin, silver, stainless steel, gold, and/or blends thereof. Exemplary particle sizes of the metal powder are within the range of about 50-100 microns; however, other sizes may be utilized.

Exposing the one or more surfaces containing the adhesive substance to the heterogeneous mixture of polymeric powder and metal powder may be performed in various ways. In some embodiments, a container of the powder mixture is capped with a mesh screen, and the powder mixture is applied to a surface like salt from a salt shaker. The target object may be stationary or may be rotated to position all surfaces thereof to the descending particles. In some embodiments, the object is conveyed through a curtain of the mixture of polymeric powder and metal powder falling under the force of gravity from a source. The object may be stationary or may be rotated to position all surfaces containing an adhesive substance to the powder mixture as it is conveyed through the powder mixture curtain.

In other embodiments, the object is agitated within an enclosure containing the powder mixture. For example, the object may be placed within a bag, or other container, containing the powder mixture and then shaken to expose the surface(s) of the object having an adhesive substance thereon to the powder mixture.

In some embodiments, a second heterogeneous mixture of polymeric powder and metal powder is applied to the adhesive substance on a surface prior to heating the object to the second temperature. The metal powder in the second mixture is different from the metal powder in the first mixture, and the polymeric powder and metal powder in the second mixture have a specific gravity difference of at least 2. As with the first powder mixture, the polymeric powder in the second mixture comprises between about 10% and 90% by volume of the second mixture.

Figure 6A:
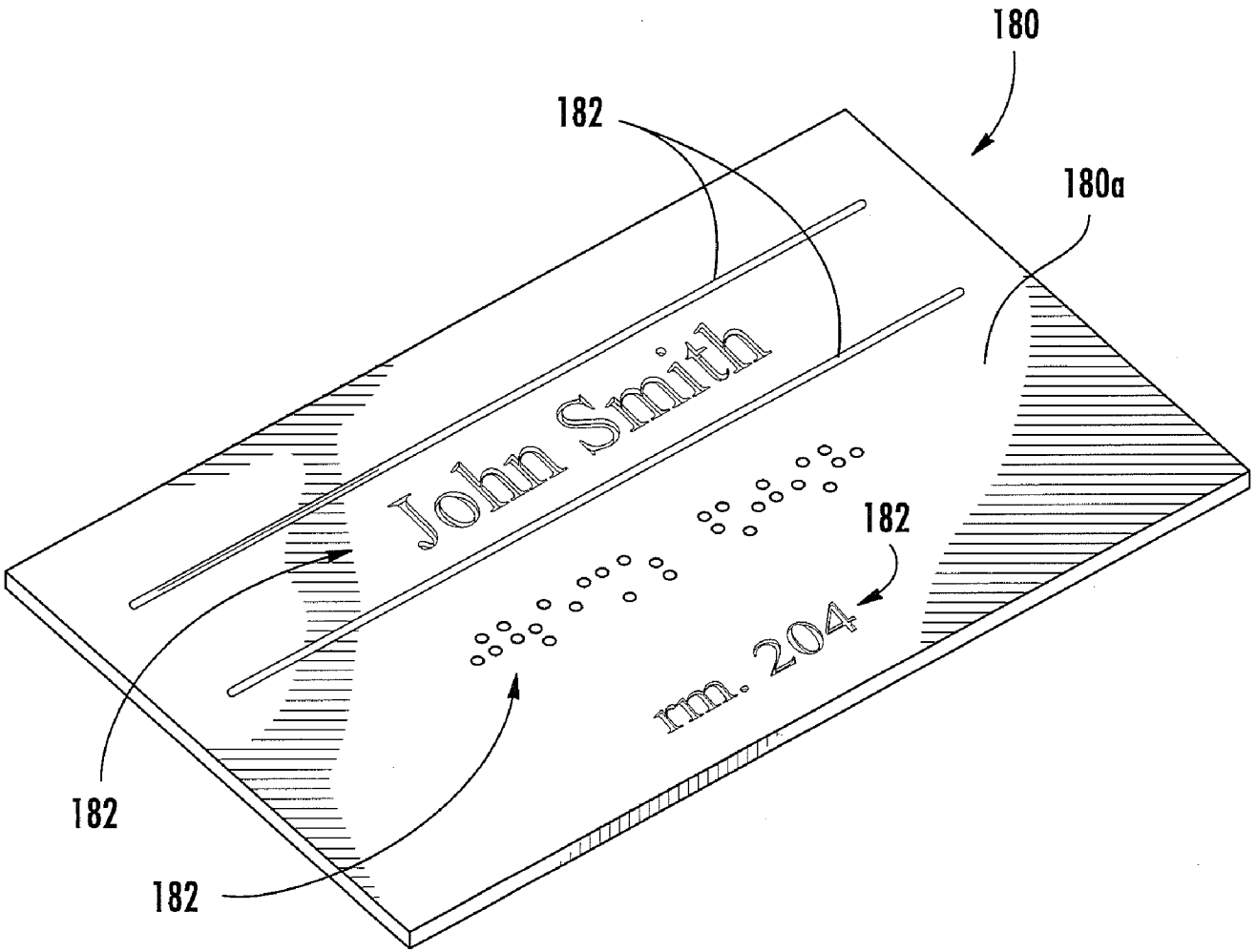
FIG. 6A is a perspective view of a mold for use in preparing articles, according to embodiments of the present invention.
Figure 6B:
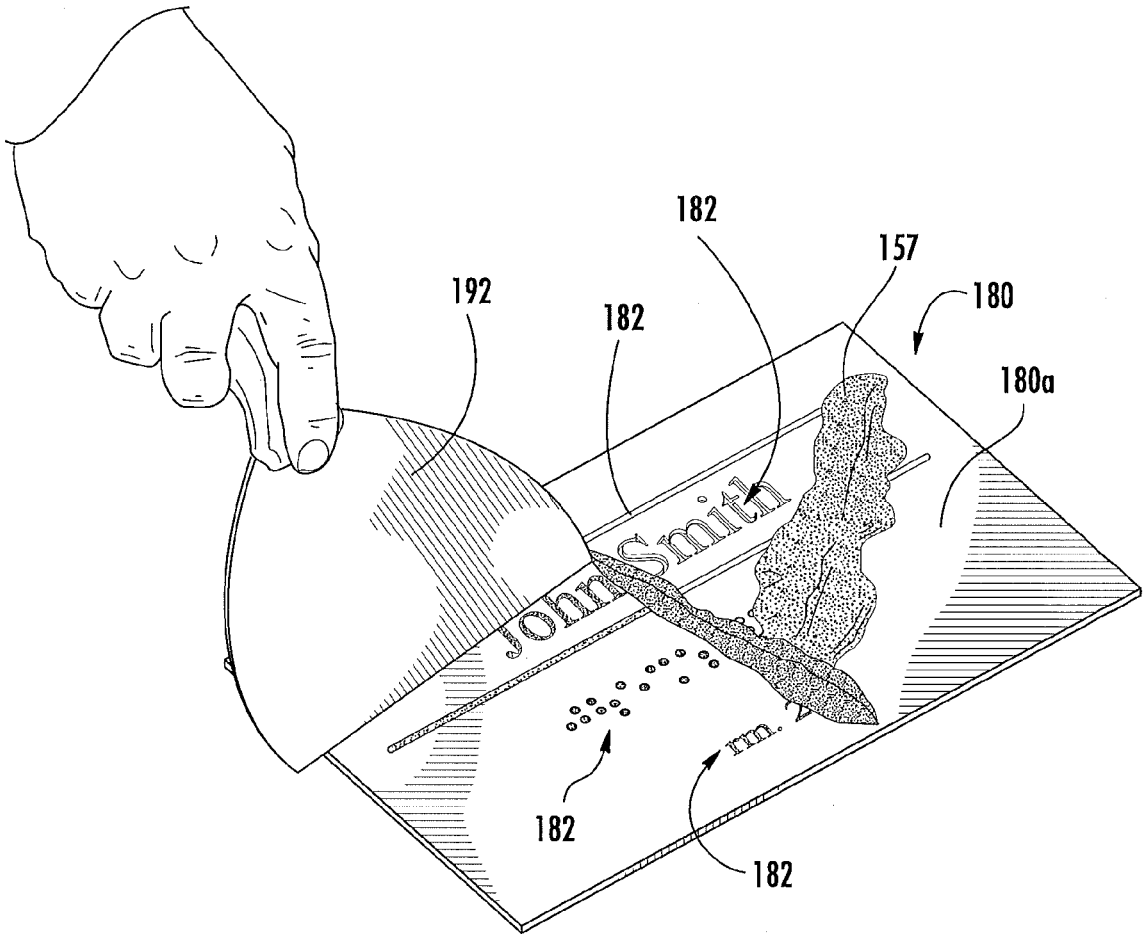
FIG. 6B illustrates powdered thermoplastic material being applied to the mold of FIG. 6A so as to fill the various recesses in the mold.

Referring to FIGS. 6A-6B, in other embodiments, an object 180 may have patterns, text, or other graphics engraved (indicated as 182) in a surface 180*a* thereof. A heterogeneous mixture 157 of polymeric powder and metal powder is drawn across the object surface 180*a*, for example via a doctor blade 192 (FIG. 6B). The powder mixture 157 fills the engraved pattern(s) 182. The object is then heated for a period of time sufficient to cause the polymeric powder to cure and form a coating within the engraved pattern(s) in the surface 180*a*. The cured polymeric coating may then be subjected to one or more finishing operations, such as polishing, buffing, sanding, chemical treatment, etc., as described above. The resulting coating contains a substantially equal distribution of metal powder throughout a thickness thereof, as described above.

Powder mixtures utilized in the various embodiments of the present invention cannot be applied using conventional powder coating technology. The large difference in specific gravities of the particles of the host polymeric material and the metal particles makes application via conventional electrostatic spray gun technology and conventional fluidized bed technology difficult. Both of these methods would rapidly segregate the metal particles and the polymer particles from a powder source. As such, a metal coating having a consistent plastic to metal ratio throughout would be difficult, if not impossible, to obtain. In contrast, embodiments of the present invention do not segregate the polymer and metal particles during application.

Metal coatings produced via embodiments of the present in some ways are chemically similar to coatings obtained using liquid polymers, yet, without any of the process and environmental disadvantages. For example, the melting process in the various methods of the present invention only causes polymer flow to a very limited degree, thereby avoiding sagging, running and especially segregation by settling. Moreover, the polymer matrix melts in place leaving no stratification of the materials. The post finishing therefore requires a minimum of abrasive action to remove the polymer coating which encases and surrounds the metal particles. Embodiments of the present invention also have the significant advantage of excellent adhesion to virtually any substrate which is not true of polyester based liquid coating processes. In addition, embodiments of the present invention have the very practical advantage of being able to use very flexible polymers, such as urethanes, for application on flexible surfaces such as leather or cloth. As such, metal coatings, according to embodiments of the present invention, can be made to resist cracking even on flexible objects and substrates. The ability to create a flexible metal coating also allows composites such as sheet plastic with the metal coating to be post formed, which is not true of rigid metalizing processes.

Other advantages of embodiments of the present invention include the ability to apply a metal coating to targeted areas on a surface, and to create layers of metal coatings, giving the ability to create blends, fades and other desirable aesthetics using a plurality of metals, such as nickel with copper, etc. Embodiments of the present invention are efficient as well as environmentally sound. Virtually 100% of the powder mixture that is not adhered to an object surface can be recovered and recycled, for example, by positioning a collector under a target object. As such, virtually no material is wasted or transferred to the environment.

In addition, a wide variety of aesthetics are possible utilizing embodiments of the present invention. By changing the ratios of plastic powder to metal powder and/or the type and melt temperature of the plastic powder, a wide range of surface textures from smooth to coarse may be achieved. Different metal powders may be combined to create different metal tones. For example, copper powder may be added to brass powder to create a rich gold colored metal. The polymer powder my may be clear in color which will result in a metallic coating identical to the metal component. The use of colored powder results in a coating with a "hue" of the polymer powder color which may be enhanced in a post-finishing procedure. These metal coatings may be chemically treated after the polishing step to create desirable aesthetics such as patinas, oxidized surfaces, and the like.

EXAMPLES

Example 1

A plaster figurine was mounted on a fixture. A mixture of clear thermoset polyester plastic powder was mixed with 200 mesh bronze powder at a ratio of 2 parts plastic powder to 1 part bronze powder by volume. The figurine was sprayed uniformly with a water based acrylic coating and then inserted in a gravity powered polymer/metal powder cloud chamber that produced a curtain of the powder mixture. The figurine was rotated in an asymmetric pattern to expose all surfaces to the powder mixture.

A coating of powder adhered to the surface of the figurine with a thickness proportional to the thickness of the acrylic coating. The figurine was placed in a low temperature (less than 100 degrees C.) oven to flash off the water content of the coating. The figurine was then placed in a high temperature oven (190 degrees C.) for ten minutes. The figurine was then removed and cooled, and finished to a satin luster with 3/0 steel wool. The resulting metal coating gave the figurine a mildly textured appearance much like a sand cast solid bronze statuette. The surface, left uncoated (with a clear lacquer or the like) slowly darkens and dulls with time like cast bronze.

Example 2

A plaster figurine was mounted on a fixture. A mixture of clear thermoset polyester plastic powder is mixed with 200 mesh bronze powder at a ratio of 2 parts plastic powder to 1 part bronze powder by volume. The figurine was heated to 170 degrees C. and inserted in a gravity powered polymer/metal powder cloud chamber that produced a curtain of the powder mixture. The figurine was rotated in an asymmetric pattern to expose all surfaces.

A coating of powder adhered to the surface of the figurine as the thermoset portion reached its melt temperature. The figurine was then placed in a low temperature (less than 100 degrees C.) oven to flash off the water content of the coating. The figurine was then placed in a high temperature oven (190 degrees C.) for ten minutes. The figurine was removed and cooled, and finished to a satin luster with 3/0 steel wool. The resulting metal coating gave the figurine a mildly textured appearance much like a sand cast solid bronze statuette. The surface, left uncoated (with a clear lacquer or the like) slowly darkens and dulls with time like cast bronze.

Example 3

A mixture of clear thermoset polyester plastic powder was mixed with 200 mesh bronze powder at a ratio of 2 parts plastic powder to 1 part bronze powder by volume. An aluminum plate was prepared by sandblasting the surface and then placed horizontally beneath a 155 mesh silk screen. A measured amount of the powder mixture was deposited on one end of the silk screen. A rubber squeegee was used to draw the powder mixture along the surface of the screen precipitating the mixture in a uniformed fashion on the surface of the aluminum part. This step was repeated until the measured amount of powder had all passed through the screen.

The aluminum plate with its powder layer was placed in an oven at 170 degrees C. for a period of 10 minutes. The plastic material was cured and adhered to the aluminum plate. The coated plate was then cooled and polished with steel wool. The plate was then chemically treated with a mild acid to promote oxidation of the bronze coating to create a patina simulating aged bronze.

Example 4

A mixture of clear thermoset polyester plastic powder was mixed with 200 mesh bronze powder at a ratio of 2 parts plastic powder to 1 part bronze powder by volume. An image of an eagle silhouette was photoetched into a 155 mesh silk screen. The silk screen was positioned over an aluminum plate with one millimeter of clearance between the plate and the silk screen. A measured amount of the powdered mixture was deposited on one end of the silk screen. A rubber squeegee was used to draw the mixture over the eagle pattern in the silk screen. This step was repeated until the measured amount of powder had all passed through the screen.

The plate was moved gently so as not to disturb the pattern of deposited powder to an oven set at 170 degrees C. The plate remained in the oven for 10 minutes until the powder mixture had fully cured. The resulting raised bronze image was buffed to a high satin with 3/0 steel wool.

Example 5

A mixture of clear thermoset polyester plastic powder was mixed with 200 mesh bronze powder at a ratio of 2 parts plastic powder to 1 part bronze powder by volume. An image of an eagle silhouette was photoetched into a 320 mesh silk screen. The silk screen was placed over an aluminum plate. A clear ink was deposited on the screen. A rubber squeegee was used to force the ink through the silhouetted pattern onto the surface of the aluminum plate. A resulting wet pattern was deposited on the surface of the aluminum plate in the shape of a silhouetted eagle.

The plate was placed under a 155 mesh silk screen. A measured quantity of the powder mixture was deposited on the screen. A rubber squeegee was used to draw the powder mixture along the surface of the screen precipitating the mixture in a uniformed fashion on the surface of the aluminum. This step was repeated until the measured amount of powder mixture had all passed through the screen. The plate was then placed in a low temperature oven (90 degrees C.) for a period of one hour to dry the clear ink. The plate was then raised to the vertical and tapped to remove all the loose powder therefrom. The result was a pattern of powder corresponding the eagle's silhouette.

The plate was then placed in a high temperature oven of 170 degrees C. for a period of 10 minutes. The plate was removed and a raised bronze eagle silhouette was adhered to the substrate. The resulting raised bronze image was buffed to a high satin with 3/0 steel wool. The resulting eagle was virtually identical to the eagle produced in Example 4.

Example 6

A mixture of clear thermoset polyester plastic powder was mixed with 200 mesh bronze powder at a ratio of 2 parts plastic powder to 1 part bronze powder by volume. The mixture was placed in a shaker device like a flour sifter. The object to be coated was a sheet of white solid surface material such as Corian® brand material. A coating of the mixture was dusted onto the surface of the material to a mill thickness of approximately 0.015". The object was placed into a convection oven for 15 minutes at a temperature of 180 degrees C.

An aluminum embossing mold was prepared with a floral pattern in reverse relief. The heated, coated sheet was placed on the lower platen of a high pressure cold platen press. The embossing mold was positioned on the bronze coated sheet. The press was closed and the assembly was subjected to pressure in the range of 2000 psi. The part was removed when cooled. The resulting object was a bas relief bronze sheet which was then subjected to post finishing (3/0 steel wool) to create a lustrous patina.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A method of coating an object, comprising:

causing a mixture of polymeric powder and metal powder to fall under the force of gravity from a source onto one or more surfaces of an object, wherein neither the object nor particles in the mixture of polymer powder and metal powder are electrically charged, wherein the polymeric powder and metal powder have a specific gravity difference of equal to or greater than 2, wherein the polymeric powder comprises between about 10% and 90% by volume of the mixture; and heating the one or more surfaces for a period of time sufficient to cause the polymeric powder to cure and form a coating on the one or more surfaces, wherein the coating contains a substantially equal distribution of metal powder throughout a thickness thereof.

2. The method of claim 1, further comprising subjecting the cured polymeric coating to one or more of the following finishing operations: polishing, buffing, sanding, and/or chemical treatment.

3. The method of claim 1, wherein the mixture of polymeric powder and metal powder is falling under the force of gravity as a curtain, and further comprising conveying the object through the curtain.

4. The method of claim 3, further comprising rotating the object as the object is conveyed through the curtain of the mixture of polymeric powder and metal powder.

5. The method of claim 1, wherein causing the mixture of polymeric powder and metal powder to fall under the force of gravity from the source onto one or more surfaces of the object comprises positioning the object beneath a screen and passing the mixture of polymeric powder and metal powder through the screen.

6. The method of claim 5, wherein the screen has a pattern and wherein passing the mixture of polymeric powder and metal powder through the screen forms a corresponding pattern on the surface of the object.

7. The method of claim 1, wherein the polymeric powder comprises a thermosetting polymeric material.

8. The method of claim 7, wherein the thermosetting polymeric material is selected from the group consisting of polyester, epoxy, acrylic, urethane, blends thereof, and hybrids thereof.

9. The method of claim 1, wherein the polymeric powder comprises a thermoplastic polymeric material.

10. The method of claim 9, wherein the thermoplastic polymeric material is selected from the group consisting of acrylic, vinyl, nylon, blends thereof, and hybrids thereof.

11. The method of claim 1, wherein the polymeric powder comprises a translucent polymeric material.

12. The method of claim 1, wherein the polymeric powder comprises a pigmented polymeric material.

13. The method of claim 1, wherein the metal powder is selected from the group consisting of copper, bronze, brass, nickel, iron, steel, tin, silver, stainless steel, gold, and blends thereof.

14. The method of claim 1, further comprising, prior to heating the one or more coated surfaces, causing a second mixture of polymeric powder and metal powder to fall under the force of gravity from a source onto the one or more coated surfaces, wherein metal powder in the second mixture is different from the metal powder in the first mixture, wherein polymeric powder and metal powder in the second mixture have a specific gravity difference of equal to or greater than 2, and wherein polymeric powder in the second mixture comprises between about 10% and 90% by volume of the second mixture.

15. The method of claim 1, wherein causing the mixture of polymeric powder and metal powder to fall under the force of gravity from a source onto one or more surfaces of the object further comprises:

heating the one or more surfaces of the object to a first temperature; and exposing the one or more heated surfaces to the falling mixture of polymeric powder and metal powder, wherein the first temperature is sufficient to cause the polymeric powder to adhere to the one or more surfaces; and wherein heating the one or more surfaces for a period of time sufficient to cause the polymeric powder to cure and form a coating comprises heating the one or more surfaces to a second temperature greater than the first temperature.

16. The method of claim 15, wherein the second temperature is greater than or equal to the melting temperature of the polymeric powder.

17. The method claim 1, wherein causing the mixture of polymeric powder and metal powder to fall under the force of gravity from a source onto one or more surfaces of the object further comprises:

applying a solvent-based adhesive substance to the one or more surfaces of the object;

exposing the one or more surfaces to the falling mixture of polymeric powder and metal powder such that the polymeric powder adheres to the adhesive substance on the one or more surfaces; and heating the one or more surfaces to a first temperature such that solvent in the solvent-based adhesive substance evaporates; and wherein heating the one or more surfaces comprises heating the one or more surfaces to a second temperature greater than the first temperature.

18. The method of claim 17, wherein the second temperature is greater than or equal to the melting temperature of the polymeric powder.

19. The method of claim 17, wherein applying the adhesive substance to one or more surfaces of the object comprises dipping the object in the adhesive substance.

20. The method of claim 17, wherein applying the adhesive substance to one or more surfaces of the object comprises spraying the adhesive substance on the one or more surfaces.

21. The method of claim 17, wherein applying the adhesive substance to one or more surfaces of the object comprises applying the adhesive substance in a pattern on the one or more surfaces of the object.

22. The method of claim 1, wherein one or more surfaces of the object comprises one or more recesses formed therein, and wherein causing the mixture of polymeric powder and metal powder to fall under the force of gravity from a source onto the one or more surfaces comprises filling the one or more recesses with the mixture.

* * * * *